US005853083A

United States Patent [19]

Furusawa et al.

[11] Patent Number: 5,853,083

[45] Date of Patent: Dec. 29, 1998

[54] CONTACT MATERIAL FOR A VACUUM CIRCUIT BREAKER AND A METHOD FOR MANUFACTURING THE SAME

[75] Inventors: Masayuki Furusawa; Hisaji Shinohara; Nobuyuki Odaka; Katsuhiko Taguchi; Yukio Osawa; Kazuro Shibata; Shoichi Ote, all of Saitama, Japan

[73] Assignee: Fuji Electric Co., Ltd., Kawasaki, Japan

[21] Appl. No.: 702,034

[22] Filed: Aug. 23, 1996

[30] Foreign Application Priority Data

Dec. 28, 1995 [JP] Japan ..... 7-354332

[51] Int. Cl.[6] ..... H01H 1/02

[52] U.S. Cl. ..... 200/264; 200/265; 200/270; 420/495; 428/567

[58] Field of Search ..... 200/264, 265, 200/266, 267, 270, 262; 420/495, 497; 428/550, 671, 567

[56] References Cited

U.S. PATENT DOCUMENTS

| | | | |
|---|---|---|---|
| 4,372,783 | 2/1983 | Kato | 200/264 |
| 4,923,509 | 5/1990 | Kemp, Jr. et al. | 420/401 |
| 4,943,322 | 7/1990 | Kemp, Jr. et al. | 420/417 |
| 5,246,512 | 9/1993 | Seki et al. | 200/266 |

*Primary Examiner*—David J. Walczak
*Attorney, Agent, or Firm*—Kanesaka & Takeuchi

[57] ABSTRACT

Interrupting and chopping characteristics of a Cu—Cr contact alloy are improved by rounding Cr particles to be spherical in the alloy. The Cr particles are rounded in the alloy by sintering raw Cr powder particles having an average particle diameter of less than 100 μm at a temperature of 1,100° C. or higher with Cu powder, or by sintering raw Cr powder particles having an average particle diameter of 100 to 150 μm at a temperature of 1,200° C. or higher with Cu powder.

14 Claims, 8 Drawing Sheets

CONTACT MATERIAL FOR A VACUUM CIRCUIT BREAKER AND A METHOD FOR MANUFACTURING THE SAME

BACKGROUND OF THE INVENTION AND RELATED ART STATEMENT

The present invention relates to a contact material used in a vacuum bulb for a vacuum circuit breaker and having excellent interrupting and chopping characteristics, and a method for manufacturing the same.

A vacuum circuit breaker has a vacuum bulb in which open/close contacts are mounted in a vacuum chamber. The vacuum bulb is provided with functions for connecting and disconnecting or opening and closing a high voltage circuit.

FIG. 6 is a cross section of a vacuum bulb. Referring now to FIG. 6, a tubular vacuum chamber 1 is made of ceramics. An outer surface of the vacuum chamber 1 is covered with a protective layer 10 formed by firing a glaze. A metal arc shield 5 is bonded to an inside wall of the vacuum chamber 1. A movable contact 4A and a stationary contact 4B are arranged in the vacuum chamber 1 such that the contacts 4A and 4B contact and separate from each other. The contacts 4A and 4B constitute one contact. The movable contact 4A is bonded to a metallic movable rod 3A. The stationary contact 4B is bonded to a metallic stationary rod 3B. Further, the movable rod 3A is bonded to a metal flange 2A via bellows 7, and the stationary rod 3B is directly bonded to a metal flange 2B. The bellows 7 is covered, on a side of the movable contact 4A, with a bellows cover 6. Metalizing layers 8 are disposed on both ends of the vacuum chamber 1. The metal flanges 2A and 2B are bonded to the respective metalizing layers 8. An exhaust pipe 11, which is vacuum sealed, is installed on the metal flange 2A. An inside of the vacuum chamber 1 is maintained under vacuum.

FIG. 6 shows a closed state of the vacuum bulb, wherein distal ends, outside the vacuum chamber 1, of the movable rod 3A and the stationary rod 3B are interposed in a main circuit (not shown). In the closed state of the vacuum bulb, the main circuit is closed or opened. Vertical movement of the movable rod 3A opens or closes between the movable contact 4A and the stationary contact 4B. The bellows 7 is arranged for movably leading out the movable rod 3A air-tightly from the vacuum chamber 1. The arc shield 5 is installed for preventing the inside wall of the vacuum chamber 1 from being contaminated by arc generated by interrupting and conducting an electric current. The bellows cover 6 is installed also for protecting the bellows 7 from the arc generated by interrupting and conducting the electric current. Before sealing, the exhaust pipe 11 is connected to a vacuum pump (not shown). After the vacuum chamber has been evacuated to an internal pressure of $10^{-2}$ Pa or lower, the exhaust pipe 11 is crushed in the middle portion thereof and sealed off.

The movable contact 4A and stationary contact 4B are the most important constituent parts which govern characteristics of the vacuum bulb. Requirements as a contact material for the movable contact 4A and stationary contact 4B include:

1) excellent interrupting characteristics,
2) excellent chopping characteristics,
3) excellent welding resistance,
4) low contact wear,
5) excellent withstand voltage characteristics,
6) low contact resistance and high current-carrying capacity, 7) little gas absorption, and
8) easy manufacturing at a low manufacturing cost.

Here, the chopping characteristics are closely related to a phenomenon which occurs during chopping of an AC current around 10 ampere. The phenomenon is that an arc current suddenly falls to zero from a certain current value, i.e. chopping value before a main circuit current falls to zero. A smaller chopping value indicates better chopping characteristics. When the chopping characteristics are not so good, a high surge voltage is caused in the main circuit, and insulation breakdown may be caused in equipments, such as motors and transformers, connected to the main circuit. Therefore, it is preferable for the contact material to exhibit a smaller chopping value. However, if the chopping value is small, the arc hardly vanishes. That is, a requirement for a smaller chopping value is contradict to a requirement for better interrupting characteristics, i.e. high interrupting capacity.

The contact material comprising copper or such a pure metal exhibits better interrupting characteristics but inferior chopping characteristics. Cu—Cr alloys, in which both characteristics are well balanced, are widely used. The alloys which contain from 20 to 50% of Cu are mainly used. As the copper content increases, the interrupting characteristics improve, but the chopping characteristics worsens. Therefore, when the interrupting characteristics are important, the alloy containing from 70 to 80% of Cu is used with sacrifice of the chopping characteristics.

The Cu—Cr alloys are prepared by sintering raw Cr powder at around 1,000° C. by the following methods.

First Conventional Method

A material or compact containing Cr and Cu powders mixed at a desired ratio is sintered.

Second Conventional Method

A sintered material or compact is prepared by sintering Cr powder alone or a mixture of Cr and Cu powders. Then, the sintered material or compact is sintered again with Cu blocks. Or, a material or compact made of Cr powder alone or a mixture of Cr and Cu powders is sintered at once with Cu blocks.

In the second method, a Cu content of the alloy is adjusted experimentally in advance by changing a mixing ratio of the Cu powder or by changing a pressure for forming the powders. Electrolytic copper powder or atomized copper powder is used as a raw Cu powder material. And, a Cr powder mechanically pulverized in a stamp mill or a ball mill is exclusively used as the raw Cr powder material.

FIGS. 7(*a*) and 7(*b*) are micrographs showing particle shapes of the Cr powders used as the raw materials of Cu—Cr alloys. FIG. 7(*a*) shows Cr particles pulverized down to an average particle diameter of less than 100 $\mu$m, and FIG. 7(*b*) shows Cr particles pulverized down to an average particle diameter of from 100 to 150 $\mu$m. In these micrographs, white parts show the Cr particles. A scale of 0.1 mm is drawn on the lower right outside each micrograph.

As described above, the interrupting and chopping characteristics are in a trade-off relation with each other.

Though the conventional Cu—Cr alloy is an excellent contact material, the Cu content is increased to improve the interrupting characteristics while sacrificing the chopping characteristics to some extent. Or, the Cu content is decreased to improve the chopping characteristics while sacrificing the interrupting characteristics to some extent. Therefore, it has been eagerly desired to improve both the important characteristics.

Accordingly, one object of the present invention is to provide a contact material for a vacuum circuit breaker, wherein interrupting and chopping characteristics are improved by sintering Cr particles dispersed in a Cu—Cr alloy in a spherical form.

Another object of the present invention is to provide a method for manufacturing the contact material having good interrupting and chopping characteristics.

Further objects and advantages of the invention will be apparent from the following description of the invention.

SUMMARY OF THE INVENTION

According to an aspect of the present invention, there is provided a contact material for a vacuum circuit breaker, wherein the contact material includes an alloy containing spherical chrome particles dispersed in copper. Mechanically pulverized Cr powder particles have sharp corners and edges as shown in FIGS. 7(*a*) and 7(*b*). The inventors of the present invention have found that interrupting and chopping characteristics are improved by a contact alloy containing spherical Cr particles, with rounded corners and edges, dispersed in a Cu matrix. It has been also found that the spherical Cr particles dispersed in the Cu matrix do not impair the foregoing desirable features 3) through 8) at all. By rounding the corners and edges of the Cr particles, electric field localization on the corners and edges is relaxed, and the interrupting characteristics are improved. At the same time, the finely distributed Cr powder particles decrease Cu-rich regions. As the Cu-rich regions reduce, cathode points are less likely to be located in pure Cu regions, and probability of showing high chopping values is reduced.

Advantageously, a contact material which includes an alloy containing spherical chrome particles dispersed in copper is obtained by sintering chrome particles having an average grain diameter of less than 100 μm and copper at 1,100° C. or higher.

Advantageously, a contact material which includes an alloy containing spherical chrome particles dispersed in copper is obtained by sintering chrome particles having an average grain diameter from 100 to 150 μm and copper at 1,200° C. or higher.

The Cr particles may be rounded by the following reasons. Though chrome can not be dissolved in solid copper, chrome can be dissolved in liquid copper, and the dissolved amount of chrome in copper increases with increasing temperature. The Cr particles are dissolved in copper at first from corner portions with high surface energy, and then to linear edge portions thereof. Thus, the Cr particles are rounded. Since more portions of the Cr particles are dissolved in copper as the particle diameter of the Cr particles increases, a higher sintering temperature and a longer sintering period are naturally required. Chrome once dissolved in copper precipitates in copper as finely-grained particles as a temperature lowers during a cooling process subsequent to heating. Thus, Cu—Cr alloys in which the fine Cr particles are distributed uniformly can be obtained.

BRIEF DESCRIPTION OF THE DRAWINGS

FIG. 1(*b*) is a micrograph of another alloy prepared from raw Cr powder particles with an average particle diameter of less than 100 μm according to the present invention;

FIG. 2(*b*) is a micrograph of another alloy prepared from raw Cr powder particles with an average particle diameter of 100 to 150 μm according to the present invention;

FIG. 7(*b*) is a micrograph of raw Cr powder particles crushed to an average particle diameter of 100 to 150 μm;

FIG. 8(*b*) is a micrograph of a comparative example of Cu—Cr alloy; and

FIG. 8(*c*) is a micrograph of another comparative example of Cu—Cr alloy.

DETAILED DESCRIPTION OF PREFERRED EMBODIMENTS

Hereinafter, the present invention is explained in detail by way of preferred embodiments thereof. Ten Cu—Cr alloys were prepared by changing preparation conditions and compositions thereof. Micrographs of the alloys were taken to observe textures thereof. Also, contact material characteristics of the alloys were investigated in vacuum bulbs. The results are described in the following.

Table 1 lists preparation conditions and compositions of the Cu—Cr alloys prepared from raw Cr powder of less than 100 μm in an the average particle diameter.

TABLE 1

Figure 1A:
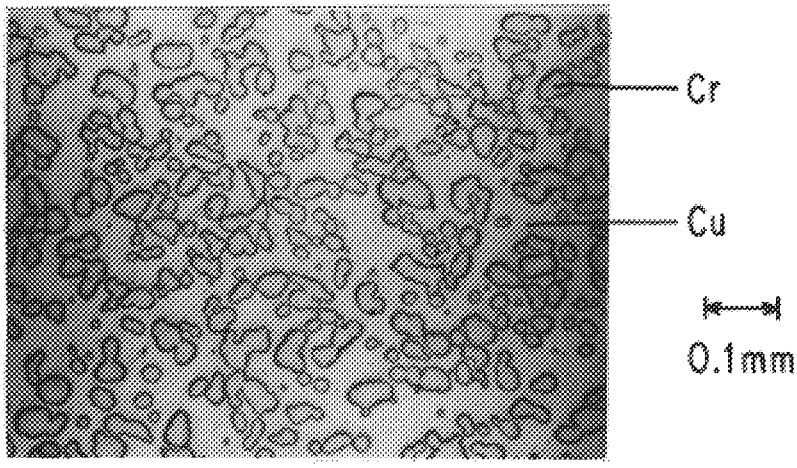
FIG. 1(*a*) is a micrograph of an alloy prepared from raw Cr powder particles with an average particle diameter of less than 100 μm according to the present invention.
Figure 1B:
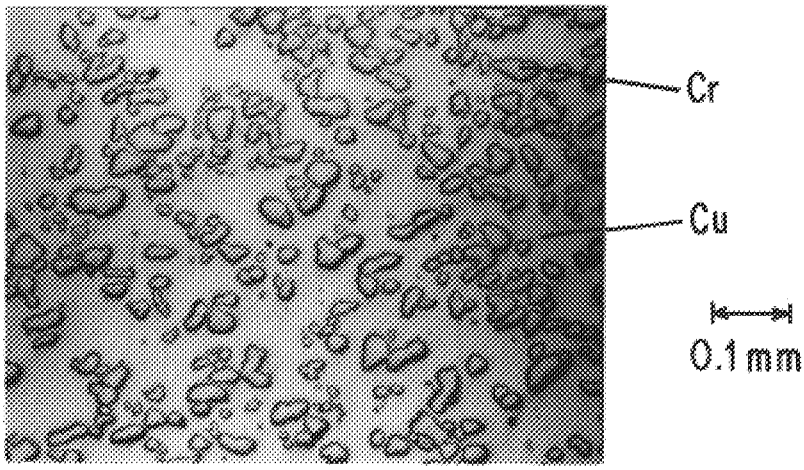
Figure 8A:
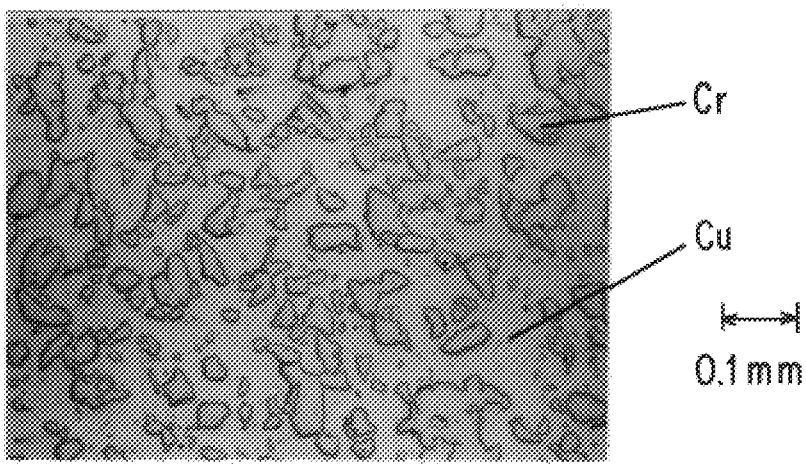
FIG. 8(a) PRIOR ART
FIG. 8(*a*) is a micrograph of a conventional Cu—Cr alloy.

| Alloys | Powder Cu ratio | After treatment conditions for powder compacts | Cu ratio in alloys | Micrographs of alloys |
|---|---|---|---|---|
| 1st Prior Art | 75.0% | Pressed under 490 Pa | 75.0% | FIG. 8(a) |
| 1st Embodiment | 5.0% | Sintered at 1100° C. for 30 min. with Cu block | 47.1% | Similar Cr particles as those in FIG. 1 |
| 2nd Embodiment | 25.0% | Sintered at 1100° C. for 30 min. with Cu block | 58.0% | Similar Cr particles as those in FIG. 1 |
| 3rd Embodiment | 65.0% | Sintered at 1100° C. for 30 min. with Cu block | 71.5% | FIG. 1(a) |
| 4th Embodiment | 85.0% | Sintered at 1100° C. 30 min. with Cu block | 82.1% | FIG. 1(b) |

In Table 1, an alloy of the 1st prior art was prepared by the conventional method, and the 1st through 4th embodiments were prepared by the method according to the invention. Cu powder with an average particle diameter of 200 μm or less and Cr powder with an average particle diameter of less than 100 μm were used as raw powder materials, which were mixed in a V-shaped mixer. In Table 1, "powder Cu ratio" represents weight % of Cu powder in a powder mixture. Therefore, weight % of Cr powder is obtained by subtracting the powder Cu ratio from 100%. The powder Cu ratio increases with embodiment number advances. In all the cases, each powder mixture was previously pressed to be a circular compact, i.e. tablet, of 50 mm in an outer diameter and 10 mm in thickness.

In the 1st prior art, a circular tablet was formed previously under a pressure of 490 MPa. The tablet was sintered in vacuum at 900° C. for 60 minutes as a preliminary treatment. Then, the sintered tablet was pressed again under the pressure of 490 MPa as an after-treatment as described in Table 1. In Table 1, "Cu ratio in alloy" represents weight % of Cu in a Cu—Cr alloy. Therefore, weight % of Cr in the alloy is obtained by subtracting the Cu ratio in the alloy from 100%. In the 1st prior art, the Cu ratio is 75% in the alloy which is the same as the powder Cu ratio. A micrograph of the Cu—Cr alloy of the 1st prior art is shown in FIG. 8(*a*). The Cr particles are scattered in a Cu matrix. A scale of 0.1 mm is drawn outside a lower right portion of each of the micrographs shown in FIGS. 8(*a*), 8(*b*) and 8(*c*). A scale of 0.1 mm is also drawn outside the lower right portion of each of FIGS. 1(*a*), 1(*b*) and FIGS. 2(*a*), 2(*b*) explained later.

In the 1st through 4th embodiments of the Cu—Cr alloys, the powder compacts were prepared by changing Cu powder ratios in the powder mixtures. In all the embodiments, the powder compacts were prepared by pressing under a pressure of 98 MPa, and the thus prepared powder compacts were sintered in vacuum at 900° C. for 60 minutes. Then, the sintered compacts were again sintered with Cu blocks at 1,100° C. for 30 minutes under after-treatment conditions described in Table 1. The Cu ratios in the thus prepared Cu—Cr alloys in the embodiments were listed in Table 1. The Cu ratios in the alloys increase with increased Cu ratios in the powder mixtures. In the 4th embodiment, the Cu ratio is 82.1% in the alloy, which is less than 85% of the powder mixture. The less Cu ratio in the alloy may be caused by excessive Cu which flowed outside the alloy. Any voids or vacant spaces were observed inside the alloy.

Micrographs of the Cu—Cr alloys of the 3rd and 4th embodiments are shown in FIGS. 1(*a*) and 1(*b*), respectively. In these micrographs, finely-grained spherical Cr particles are scattered throughout the Cu matrix. The shapes of the Cr particles in the alloys of the 1st and 2nd embodiments are similar to those of the 3rd and 4th embodiments, and their micrographs are omitted.

Figure 7A:
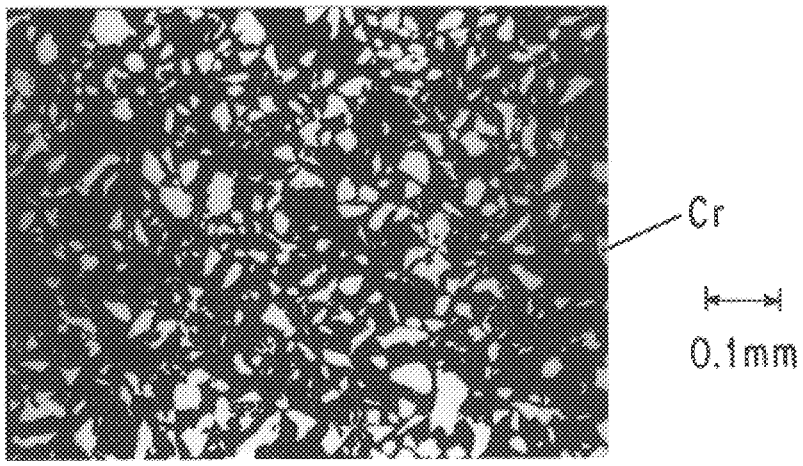
FIG. 7(*a*) is a micrograph of raw Cr powder particles crushed to an average particle diameter of less than 100 μm.
Figure 7B:
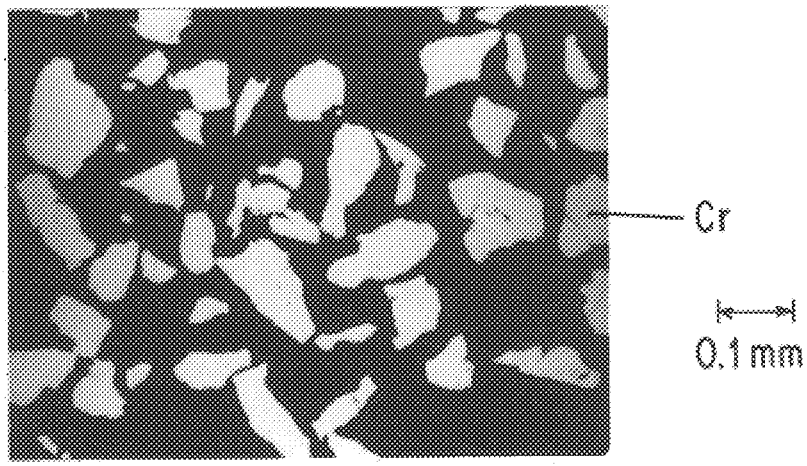

As shown in FIG. 8(*a*), the Cr particles in the alloy of the 1st prior art have sharp corners and linear edges in the very similar manner to Cr particles in a raw powder material shown in FIG. 7(*a*). The Cr particles in the raw powder material have sharp corners and linear edges. Many concave and convex portions are observed on the surfaces of the raw Cr powder particles. Therefore, the Cr particles of the 1st prior art were not changed so much from the initial shapes thereof, while the raw Cr powder was changed to fine spherical particles through the sintering at a high temperature of 1,100° C. for 30 minutes in the 1st through 4th embodiments. As will be explained later, the interrupting and chopping characteristics of the 1st through 4th embodiments are improved more than those by the 1st prior art.

Table 2 lists preparation conditions and compositions of the Cu—Cr alloys prepared from Cr powder of 100 to 150 μm in an average particle diameter.

TABLE 2

Figure 2A:
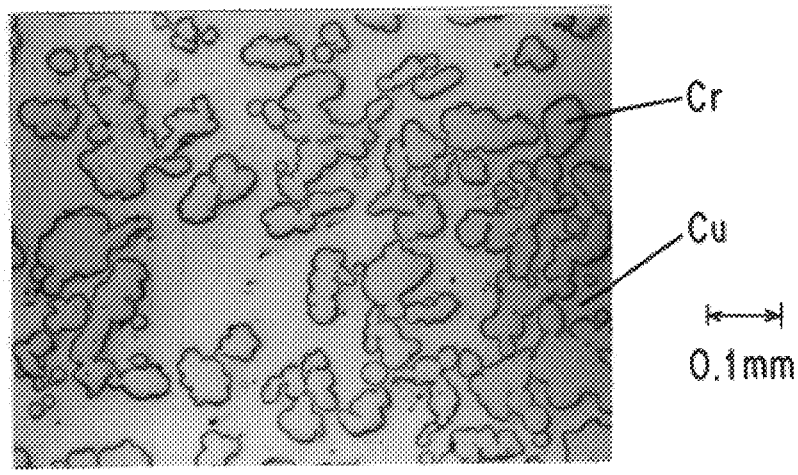
FIG. 2(*a*) is a micrograph of an alloy prepared from raw Cr powder particles with an average particle diameter of 100 to 150 μm according to the present invention.
Figure 2B:
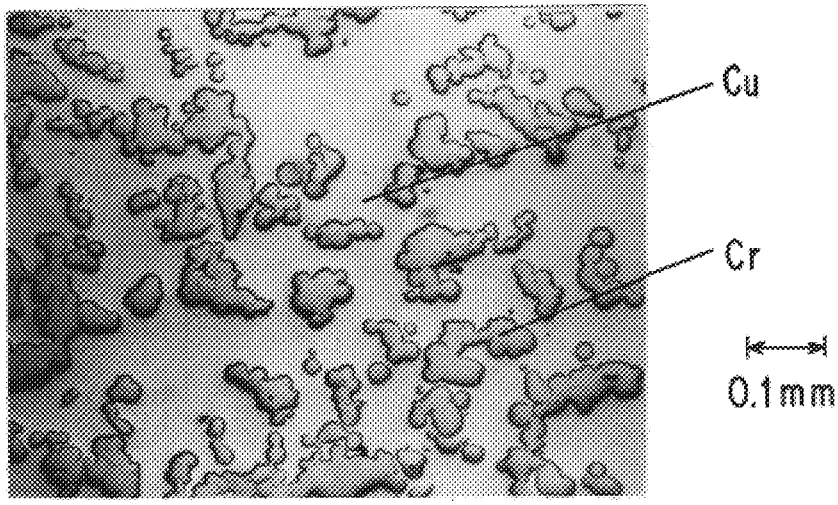
Figure 8B:
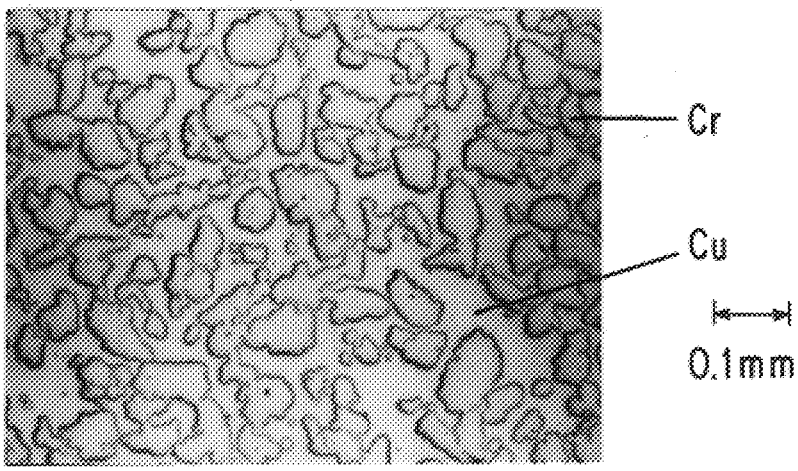
Figure 8C:
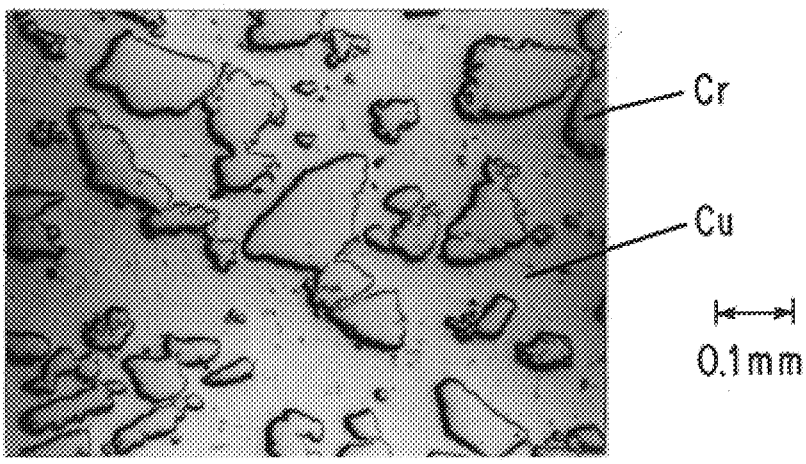

| Alloys | Powder Cu ratio | After treatment conditions for powder compacts | Cu ratio in alloys | Micrographs of alloys |
|---|---|---|---|---|
| 1st Comparative Example | 5.0% | Sintered at 1150° C. for 30 min. with Cu block | 51.2% | FIG. 8(b) |
| 2nd Comparative Example | 55.0% | Sintered at 1150° C. for 30 min. with Cu block | 73.5% | FIG. 8(c) |
| 5th Embodiment | 40.0% | Sintered at 1250° C. for 60 min. with Cu block | 60.5% | Similar Cr particles as those in FIG. 2 |
| 6th Embodiment | 55.0% | Sintered at 1250° C. for 60 min. with Cu block | 74.8% | FIG. 2(a) |
| 7th Embodiment | 50.0% | Sintered at 1300° C. for 60 min. with Cu block | 75.0% | FIG. 2(b) |

In Table 2, 1st and 2nd comparative examples alloys were prepared similar to the 1st and 3rd embodiments, and the 5th through 7th embodiments were prepared by the method of the present invention. Cu powder with an average particle diameter of 200 μm or less and Cr powder with an average particle diameter of 100 to 150 μm were used as raw powder materials, and were mixed in a V-shaped mixer. In Table 2, definitions of "powder Cu ratio" and "Cu ratio in alloys" are the same as those in Table 1. In all the cases, the powder mixtures were previously pressed under a pressure of 98 MPa to be a circular compact, i.e. tablet, of 50 mm in an outer diameter and 10 mm in thickness.

The tablets of the 1st comparative example, 2nd comparative example, 5th embodiment and 6th embodiment were sintered in vacuum at 900° C. for 60 minutes as a preliminary treatment. The tablet of the 7th embodiment was sintered in vacuum at 1,200° C. for 60 minutes as a preliminary treatment. Then, the sintered compacts of the 1st comparative example and 2nd comparative example were again sintered with Cu blocks at 1,150° C. for 30 minutes under the respective after-treatment conditions described in Table 2. The sintered compacts of the 5th and 6th embodiments were again sintered with Cu blocks at 1,250° C. for 60 minutes. The sintered compact of the 7th embodiment was again sintered with Cu blocks at 1,300° C. for 60 minutes.

Micrographs of the alloys of the 6th and 7th embodiments are shown in FIGS. 2(*a*) and 2(*b*). In these micrographs, finely-grained spherical Cr particles are scattered throughout a Cu matrix. Since the shapes of the Cr particles in the alloy of the 5th embodiment are almost similar to those of the 6th embodiment, an alloy texture of the 5th embodiment is not shown herein.

As shown in FIGS. 8(*b*) and 8(*c*), the Cr particles in the alloys of the 1st comparative example and 2nd comparative example sharp corners and linear edges still in a similar manner to the Cr particles in a raw powder material shown in FIG. 7(*b*). In spite of the after-treatment at a high temperature of 1,150° C., the Cr particles were not changed so much from the initial states thereof in the 1st comparative example and 2nd comparative example. On the other hand, the raw Cr powder particles were changed to fine spherical particles through the after-treatment at a high temperature of more than 1,200° C. for 60 minutes in the 5th through 7th embodiments. It has been also found that high temperature sintering for a prolonged period of time is necessary for rounding the Cr particles with a larger particle diameter. As will be explained later, the interrupting and chopping characteristics of the 5th through 7th embodiments are improved more than those by the 1st prior art.

Though the powder compacts were preliminarily sintered at a temperature of 900° to 1,200° C. in the embodiments described above, the Cu—Cr alloys similar to those listed in Tables 1 and 2 were obtained by sintering the powder compacts under the after-treatment conditions listed in Tables 1 and 2. Or, the Cu—Cr alloys similar to those listed in Tables 1 and 2 were obtained by sintering the powder mixtures which contain Cu powder and Cr powder at a certain ratio, and were loaded in a Cu vessel. In the after-treatment, a sintering period of at least 30 minutes or longer is necessary, since the Cr particles are not rounded enough within 10 to 20 minutes. However, when a higher sintering temperature is adopted, the sintering time may be shortened to less than 30 minutes to obtain well rounded Cr particles.

The Cu—Cr alloys of the above described prior art, comparative examples and embodiments were evaluated as the contact materials for the vacuum bulbs.

In Table 3, the interrupting and chopping characteristics of the alloys are compared.

TABLE 3

| Alloys | Cu ratio in alloys | Interrupting characteristics | Chopping characteristics |
|---|---|---|---|
| 1st Prior Art | 75.0% | 1.0 | 1.0 |
| 1st Embodiment | 47.1% | 1.15 | 1.75 |
| 2nd Embodiment | 58.0% | 1.51 | 1.69 |
| 3rd Embodiment | 71.5% | 1.53 | 1.39 |
| 4th Embodiment | 81.1% | 1.48 | 1.01 |
| 1st Compartive Example | 51.2% | 1.15 | 1.49 |
| 2nd Comparative Example | 73.5% | 1.38 | 1.02 |
| 5th Embodiment | 60.5% | 1.55 | 1.61 |
| 6th Embodiment | 74.8% | 1.53 | 1.39 |

The interrupting and chopping characteristics were expressed by relative average values of 300 test runs with respect to the values of the 1st prior art. The interrupting characteristics were represented by relative interrupting current values. Since a smaller chopping current is preferable, the chopping characteristics were represented by relative reciprocal values of the chopping current. Therefore, larger values in Table 3 indicate better characteristics of the contact alloys for vacuum bulbs. The interrupting characteristics of all the embodiments were improved as compared with those of the 1st prior art. Also, the chopping characteristics of all the embodiments were improved as compared with those of the 1st prior art. If alloys containing about 75% of Cu, i.e. the 1st prior art, the 3rd embodiment and the 6th embodiment, are compared, the interrupting and chopping characteristics of the embodiments are 1.5 times and 1.4 times, respectively, as much as those of the 1st prior art. If alloys having average diameters of raw powder particles from 100 to 150 $\mu$m, i.e. the 1st and 2nd comparative examples and the 5th and 6th embodiments, are compared, both the interrupting and chopping characteristics of the embodiments are from 1.1 to 1.3 times as much as those of the comparative examples. Though not listed in Table 3, the interrupting and chopping characteristics of the 7th embodiment are improved as compared with those of the 1st and 2nd comparative examples. Therefore, the interrupting and chopping characteristics are improved as fine spherical Cr particles increase in an alloy texture.

Figure 3:
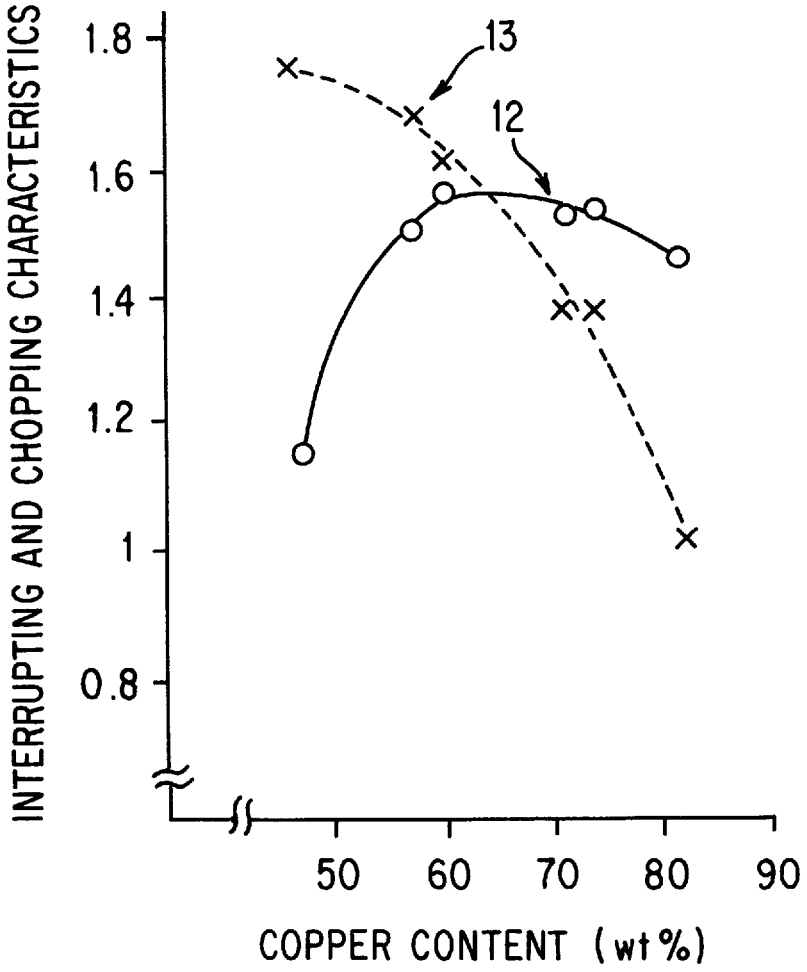
FIG. 3 is a pair of characteristic curves showing a relationship between interrupting and chopping characteristics of alloys and Cu ratios in alloys of the invention.

FIG. 3 is a pair of characteristic curves showing a relationship of the interrupting and chopping characteristics of alloys relative to Cu ratios in the alloys. The abscissa represents the Cu ratio, and the ordinate represents the interrupting and chopping characteristics. In the figure, values for the 1st through 6th embodiments listed in Table 3 are plotted by open circles on a curve 12 representing the interrupting characteristics and by crosses on a curve 13 representing the chopping characteristics. Though there still remains a tendency that the chopping characteristics become worse with increasing the Cu ratios in the alloys, the interrupting and chopping characteristics exceed 1 due to distribution of the fine spherical Cr particles in the alloys.

Figure 4:
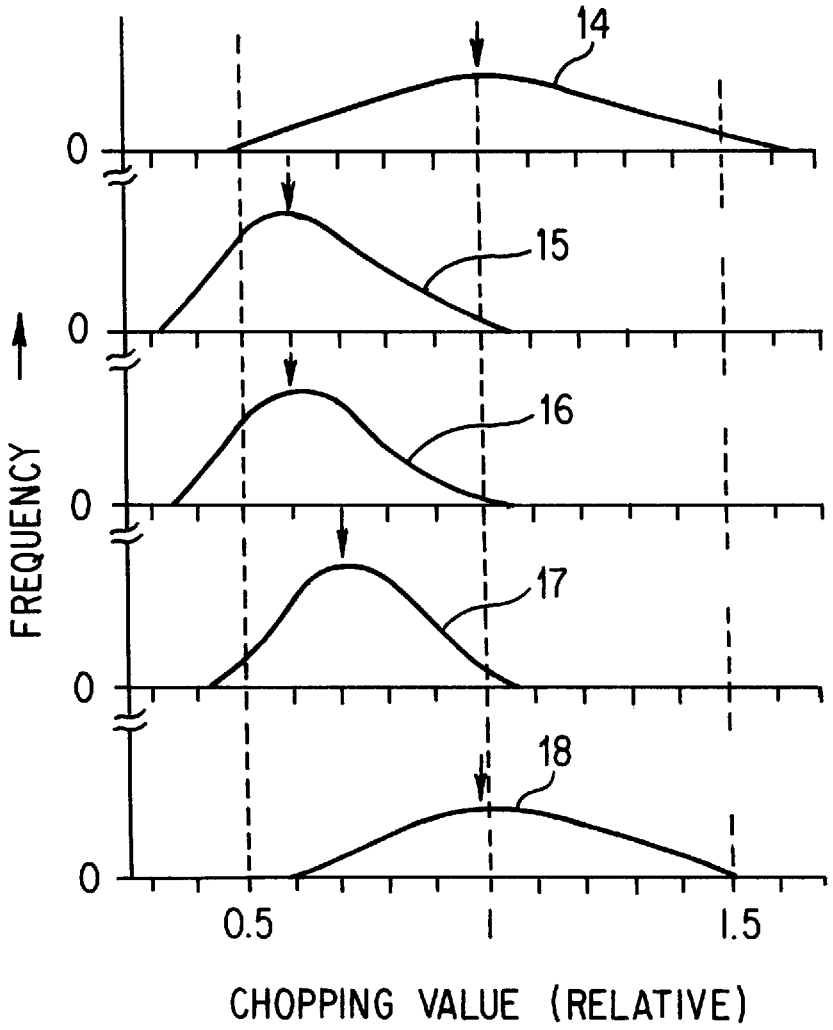
FIG. 4 shows distribution charts illustrating frequencies of chopping values, i.e. chopping currents, measured on Cu—Cr alloys prepared from raw powder containing Cr particles with an average particle diameter of less than 100 μm.

FIG. 4 shows distribution charts illustrating frequencies of chopping values, i.e. chopping currents, measured on Cu—Cr alloys prepared from the raw powder containing Cr particles with an average particle diameter of less than 100 $\mu$m. Three hundreds test runs were conducted on each alloy. The abscissa represents relative values normalized by an average chopping value of the 1st prior art. The ordinates represent frequencies of chopping values measured through the 300 test runs. A frequency curve 14 is for the 1st prior art, and frequency curves 15 through 18 are for the 1st through 4th embodiments. On each frequency curve, an average chopping value thereof is indicated by a downward arrow.

Figure 5:
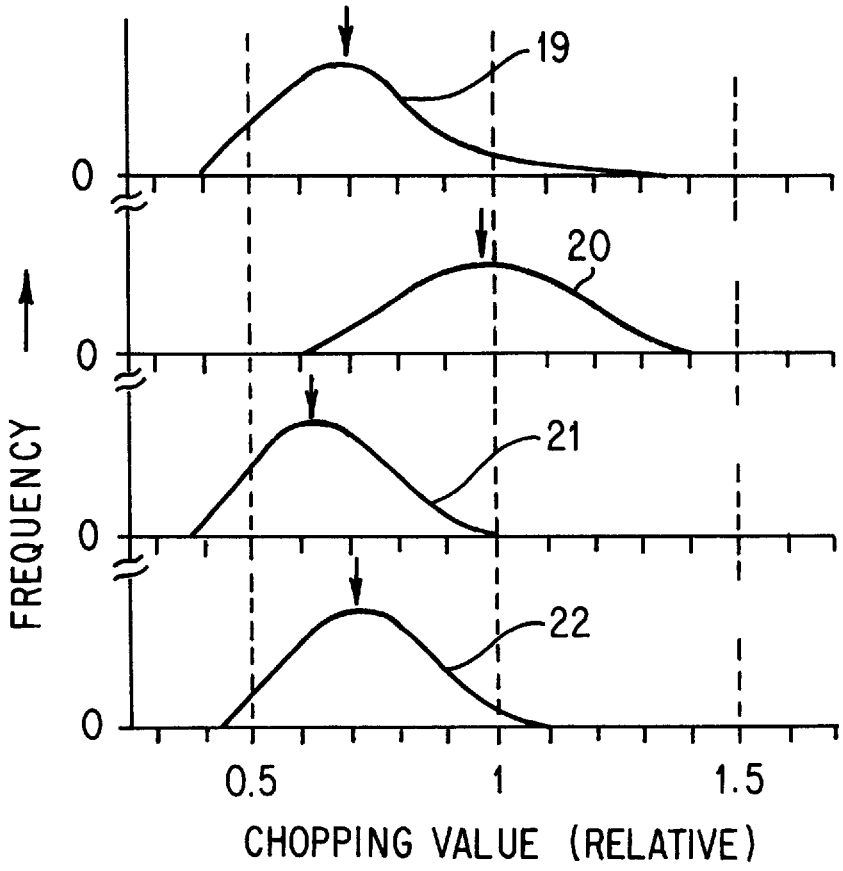
FIG. 5 shows distribution charts illustrating frequencies of chopping values, i.e. chopping currents, measured on Cu—Cr alloys prepared from raw powder containing Cr particles with an average particle diameter of 100 to 150 μm.
Figure 6:
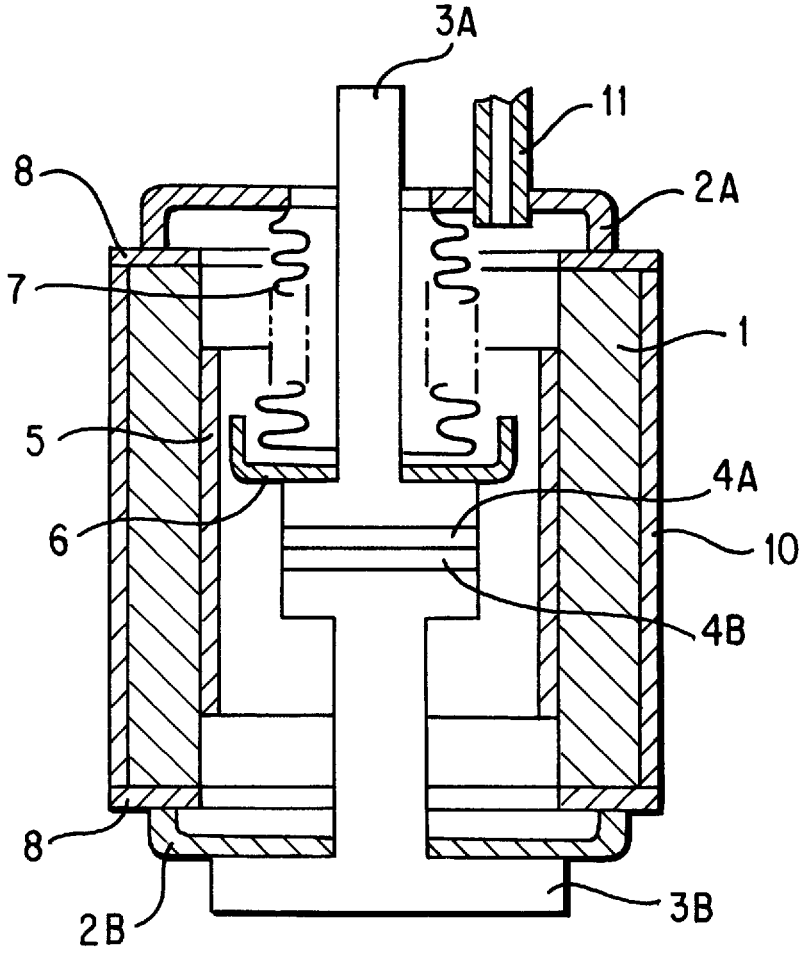
FIG. 6 is a cross sectional view of a vacuum bulb.

FIG. 5 shows distribution charts illustrating frequencies of chopping values, i.e. chopping currents, measured on Cu—Cr alloys prepared from raw powder containing Cr particles with an average particle diameter of 100 to 150 $\mu$m. As in FIG. 4, 300 test runs were conducted on each alloy. The abscissa represents relative values normalized by an average chopping value of the 1st prior art. The ordinates represent frequencies of the chopping values measured through the 300 test runs. Frequency curves 19, 20 are for the 1st comparative example and 2nd comparative example, and frequency curves 21 and 22 are for the 5th and 6th embodiments. On each frequency curve, an average chopping value thereof is indicated by a downward arrow. In FIGS. 4 and 5, the frequency curves of the embodiments are distributed more narrowly along the abscissa, indicating smaller distributions of the chopping values, than the frequency curves of the prior art.

The reason that the interrupting characteristics of the conventional and comparative Cu—Cr alloys are not so good may be attributed by electric field localization on the corners and edges of polyhedral Cr particles. Or, since Cr is oxidized easily, oxide layers covering the Cr particle surfaces may hinder sufficient sintering of the Cu and Cr particles. By making the Cr particles in a fine spherical shape as in the embodiments, electric field is relaxed and the oxide layers on the Cr particle surfaces are crushed, so that the interrupting characteristics are considered to be improved.

The reason that the chopping characteristics of the conventional and comparative Cu—Cr alloys are not so good and are distributed widely may be attributed by large Cu rich regions in the conventional and comparative alloys. When a small current flows through such Cu-rich regions, desirable properties of the Cu—Cr alloy may not be fully utilized. By making the Cr particles in a fine spherical shape as in the embodiments, the Cu-rich regions and, therefore, existing probability of cathode points in pure Cu are reduced to further reduce the probability of showing high chopping values.

The Cr particles may be rounded according to the present invention by the following reasons. Though chrome can not be dissolved in solid copper, if copper becomes a liquid phase by increasing temperature more than a melting point (1,083.4° C.), chrome can be dissolved in copper in a liquid phase, wherein a dissolved amount of chrome in copper increases with increasing temperature. The Cr particles are dissolved in copper at first from the corner portions thereof with high surface energy, and then to the linear edge portions. Thus, the Cr particles come to a spherical shape. As described earlier, the Cr particles are finely grained and rounded by sintering at 1,100° C. or higher in case of the raw Cr powder particles with an average particle diameter less than 100 μm. Since more portions of the Cr particles are dissolved in copper as an average particle diameter of the Cr particles exceeds 100 μm, a higher sintering temperature, such as 1,200° C. or higher, and a longer sintering period, such as 60 minutes, are naturally required. However, since chrome may easily be dissolved at the sintering temperature of 1,200° C. or higher, the sintering period may be shortened to less than 60 minutes. The important thing is to distribute fine spherical Cr particles throughout a Cu—Cr alloy. Chrome once dissolved in the copper precipitates in a Cu matrix as finely-grained particles as a temperature lowers during a cooling process subsequent to heating. Thus, Cu—Cr alloys in which fine Cr particles are distributed uniformly can be obtained.

The foregoing desirable features 3) through 8) of the contact materials other than the interrupting and chopping characteristics are not impaired in all the embodiments.

As explained above, by using the alloys containing the spherical Cr particles scattered in the Cu matrix as a contact material for vacuum bulbs, both the interrupting and chopping characteristics are improved, a vacuum circuit breaker is minimized, and a manufacturing cost of the vacuum circuit breaker is reduced. The other equipments connected to the vacuum bulb are not subjected to large surge currents and damages.

What is claimed is:

1. A contact material for a vacuum circuit breaker, comprising an alloy containing copper and spherical chrome particles disposed in the copper, said alloy being prepared by sintering chrome particles having an average grain diameter of less than 100 μm and powdery copper at a temperature of at least 1,100° C. to melt the chrome particles into molten copper, and cooling a mixture containing said chrome and copper so that chrome once dissolved in copper precipitates in copper as finely grained particles, which are distributed uniformly.

2. A contact material for a vacuum circuit breaker according to claim 1, wherein the copper is contained in the alloy between 47.1 wt % and 82.1 wt. %.

3. A contact material for a vacuum circuit breaker according to claim 1, wherein an average diameter of the powdery copper is less than 200 μm.

4. A method for manufacturing a contact material for a vacuum circuit breaker, comprising sintering chrome particles having an average grain diameter of less than 100 μm and powdery copper at a temperature of at least 1,100° C. to melt the chrome particles into molten copper, and cooling a mixture containing chrome and copper so that chrome once dissolved in copper precipitates in copper as finely grained particles, which are distributed uniformly.

5. A method for manufacturing a contact material according to claim 4, wherein before sintering the chrome particles and the copper, the chrome particles are mixed with copper particles, and a mixture of the chrome particles and the copper particles is heated and pressurized to form a compact, said compact containing said chrome particles and said copper and being sintered at a temperature of at least 1,100° C. with copper blocks.

6. A method for manufacturing a contact material according to claim 5, wherein said copper particles have an average diameter of less than 200 μm and are contained in the compact between 5 and 85 wt %, said alloy containing said copper between 47.1 wt % and 82.1 wt %.

7. A method for manufacturing a contact material according to claim 6, wherein said mixture of the chrome particles and the cooper particles is heated at 900° C. and pressurized at 98 MPa to form the compact.

8. A method for manufacturing a contact material for a vacuum circuit breaker, comprising sintering chrome particles having an average grain diameter from 100 to 150 μm and powdery copper at a temperature of at least 1,200° C. to melt the chrome particles into molten copper, and cooling a mixture containing said chrome and copper so that chrome once dissolved in copper precipitates in copper as finely grained particles, which are distributed uniformly.

9. A method for manufacturing a contact material according to claim 8, wherein before sintering the chrome particles and the copper, the chrome particles are mixed with copper particles, and a mixture of the chrome particles and the copper particles is heated and pressurized to form a compact, said compact being sintered at a temperature of at least 1,200° C. and higher with copper blocks.

10. A method for manufacturing a contact material according to claim 9, wherein said copper particles have an average diameter of less than 200 μm and are contained in the compact between 40 and 50 wt %, said alloy containing the copper between 60.5 wt % and 75.0 wt %.

11. A method for manufacturing a contact material according to claim 10, wherein said mixture of the chrome particles and the copper particles is heated more than 900° C. and pressurized at 98 MPa to form the compact.

12. A contact material for a vacuum circuit breaker, comprising an alloy containing copper and spherical chrome particles disposed in the copper, said alloy being prepared by sintering chrome particles having an average grain diameter from 100 to 150 μm and powdery copper at a temperature of at least 1,200° C. to melt the chrome particles into molten copper, and cooling a mixture containing said chrome and copper so that chrome once dissolved in copper precipitates in copper as finely grained particles, which are distributed uniformly.

13. A contact material for a vacuum circuit breaker according to claim 12, wherein the copper is contained in the alloy between 60.5 wt % and 75.0 wt %.

14. A contact material for a vacuum circuit breaker according to claim 12, wherein an average diameter of the powdery copper is less than 200 μm.

* * * * *

UNITED STATES PATENT AND TRADEMARK OFFICE

CERTIFICATE OF CORRECTION

PATENT NO. : 5,853,083

DATED : December 29, 1998

INVENTOR(S) : Masayuki Furusawa; Hisaji Shinohara; Nobuyuki Odaka; Katsuhiko Taguchi; Yukio Osawa; Kazuro Shibata; Shoichi Ote It is certified that error appears in the above-indentified patent and that said Letters Patent is hereby corrected as shown below:

In column 4, line 40, delete "the";

In column 6, line 59, before "sharp" add --have--;

In column 9, line 61, before "chrome" add --said--; and

In column 10, line 36, delete "and higher".

Signed and Sealed this

First Day of June, 1999

*Attest:*

Q. TODD DICKINSON

*Attesting Officer*

*Acting Commissioner of Patents and Trademarks*